US009421662B2

(12) United States Patent
Lee et al.

(10) Patent No.: US 9,421,662 B2
(45) Date of Patent: Aug. 23, 2016

(54) POLISHING APPARATUS

(71) Applicant: Samsung Electronics Co., Ltd., Suwon-Si, Gyeonggi-Do (KR)

(72) Inventors: Sung-choul Lee, Hwaseong-si (KR); Choul-gue Park, Hwaseong-si (KR); Ki-hong Jung, Yongin-si (KR); Soo-young Kim, Yongin-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/462,736

(22) Filed: Aug. 19, 2014

(65) Prior Publication Data

US 2015/0087210 A1 Mar. 26, 2015

(30) Foreign Application Priority Data

Sep. 25, 2013 (KR) ..... 10-2013-0114143

(51) Int. Cl.
*B24B 21/00* (2006.01)
*B24B 9/06* (2006.01)
*B24B 37/02* (2012.01)

(52) U.S. Cl.
CPC ..... *B24B 21/002* (2013.01); *B24B 9/065* (2013.01); *B24B 37/02* (2013.01)

(58) Field of Classification Search
CPC ..... B24B 21/002; B24B 9/065; B24B 37/02
See application file for complete search history.

(56) References Cited

U.S. PATENT DOCUMENTS

| | | | | |
|---|---|---|---|---|
| 5,632,667 | A | 5/1997 | Earl et al. | |
| 6,402,596 | B1 * | 6/2002 | Hakomori | B24B 21/002 451/168 |
| 7,682,225 | B2 * | 3/2010 | Hongo | B24B 9/065 451/168 |
| 2009/0017733 | A1 | 1/2009 | Takahashi et al. | |
| 2009/0142992 | A1 * | 6/2009 | Takahashi | B24B 9/065 451/9 |
| 2011/0237164 | A1 * | 9/2011 | Seki | B24B 9/065 451/44 |

FOREIGN PATENT DOCUMENTS

| | | | |
|---|---|---|---|
| EP | 01 055 463 | A2 | 11/2000 |
| JP | 2005-230978 | A | 9/2005 |
| JP | 2008-028204 | A | 2/2008 |
| JP | 2008-098574 | A | 4/2008 |
| JP | 2008-537317 | A | 9/2008 |
| JP | 2009-147044 | A | 7/2009 |
| KR | 1999-0074461 | A | 10/1999 |
| KR | 2004-0060559 | A | 7/2004 |
| KR | 10-1214507 | A | 12/2007 |

* cited by examiner

*Primary Examiner* — Dung Van Nguyen
(74) *Attorney, Agent, or Firm* — Harness, Dickey & Pierce, P.L.C.

(57) ABSTRACT

A polishing apparatus including a chuck for supporting a wafer while exposing a peripheral portion of the wafer, a polishing head for polishing the peripheral portion of the wafer, and a polishing solution supplying assembly provided above the chuck and configured to spray a polishing solution on the wafer and to form a liquid curtain on the chuck to protect the wafer when the wafer is polished may be provided.

12 Claims, 12 Drawing Sheets

(a)

(b)

POLISHING APPARATUS

CROSS-REFERENCE TO RELATED APPLICATIONS

This application claims priority under 35 U.S.C. §119 to Korean Patent Application No. 10-2013-0114143, filed on Sep. 25, 2013, in the Korean Intellectual Property Office, the disclosure of which is incorporated herein in its entirety by reference.

BACKGROUND

The inventive concepts relate to polishing apparatuses, and more particularly, to polishing apparatuses capable of polishing a peripheral portion of a wafer.

During manufacturing processes of a semiconductor device, an undesired film or a rough surface may be formed on a peripheral portion of a wafer. When the semiconductor device is manufactured, the peripheral portion of the wafer is held by an arm to deliver the wafer. Accordingly, the above-described undesired film formed on the wafer during the manufacturing processes of the semiconductor device may operate as particles and/or the above-described rough surface may operate as an obstacle to a photolithography process. In order to remove the undesired film and/or to relieve the rough surface, polishing the peripheral portion of the wafer by using a polishing apparatus is desired.

SUMMARY

At least some example embodiments provide polishing apparatuses capable of polishing a peripheral portion of a wafer while preventing particles from falling on the wafer.

According to an example embodiment, a polishing apparatus may include a chuck for supporting a wafer while exposing a peripheral portion of the wafer, a polishing head for polishing the peripheral portion of the wafer, and a polishing solution supplying assembly provided above the wafer for spraying a polishing solution on the wafer and to form a liquid curtain on the chuck to protect the wafer when the wafer is polished.

The polishing head may include a side surface and a top surface polishing portion capable of polishing a side surface and a top surface of the peripheral portion of the wafer. The polishing head may include a rear surface polishing portion capable of polishing a rear surface of the peripheral portion of the wafer.

The polishing solution supplying assembly may include a slit nozzle for spraying the polishing solution. The polishing solution supplying assembly may include a nozzle block that horizontally rotates with respect to the wafer.

The polishing solution supplying assembly may include a nozzle supporting block having an internal groove connected to a polishing solution supplying line, through which the polishing solution is supplied, a nozzle block including a distributing plate for distributing the polishing solution and coupled to (e.g., inserted into and fastened to) the internal groove of the nozzle supporting block and, and a slit nozzle for spraying the polishing solution and positioned between the nozzle supporting block and the nozzle block.

The distributing plate may include a through nozzle passing through the nozzle block and for supplying the polishing solution to a center of the wafer. The distributing plate may include a central through hole provided at a center and a distributing groove for radially distributing the polishing solution around an upper surface of the central through hole.

The distributing groove may be connected to the slit nozzle. The internal groove of the nozzle supporting block may include an inclined groove and the slit nozzle may be formed along a surface of the inclined groove.

According to another example embodiment, a polishing apparatus may include a chuck for supporting a wafer while exposing a peripheral portion of the wafer, a polishing head for polishing the peripheral portion of the wafer, and a polishing solution supplying assembly for spraying a polishing solution to form a liquid curtain on the chuck to protect the wafer when the wafer is polished. The polishing solution supplying assembly may include a nozzle supporting block provided on the chuck and may include an internal groove configured to receive a polishing solution supplying line, a nozzle block coupled to (e.g., inserted into and fastened to) the internal groove of the nozzle supporting block, and a slit nozzle positioned between the nozzle supporting block and the nozzle block. The nozzle bock may include a distributing plate for distributing the polishing solution and a through nozzle connected to the distributing plate.

The through nozzle of the polishing solution supplying assembly may include a first sub-through nozzle having a first diameter and connected to the distributing plate and a second through nozzle having a second diameter larger than the first diameter and connected to the first through nozzle.

The internal groove of the nozzle supporting block may include a multistage groove connected to the polishing solution supplying line and an inclined groove connected to the multistage groove. A curvature of the liquid curtain may be determined in accordance with a radial angle of the inclined groove. A diameter of the slit nozzle may be determined in accordance with a diameter of the through nozzle.

According to still another example embodiment, a polishing apparatus may include a chuck configured to at least partially support a wafer while exposing a peripheral portion thereof, a polishing pad configured to polish the exposed peripheral portion of the wafer, and a polishing solution supplying assembly above the chuck, the polishing solution supplying assembly configured to spray a polishing solution to form a liquid curtain on the chuck.

The polishing solution supplying assembly may includes a nozzle supporting block on the chuck, a nozzle block coupled to the nozzle supporting block, and a slit nozzle between the nozzle supporting block and the nozzle block. The nozzle supporting block may include an internal groove, and the nozzle block is coupled to the nozzle supporting block by coupling the nozzle block to the internal groove of the nozzle supporting block. The nozzle block may include a distributing plate configured to distribute the polishing solution and a through nozzle connected to the distributing plate. The nozzle block may be partially disposed in the internal groove.

BRIEF DESCRIPTION OF THE DRAWINGS

Various example embodiments will be more clearly understood from the following detailed description taken in conjunction with the accompanying drawings in which.

DETAILED DESCRIPTION

Figure 1:
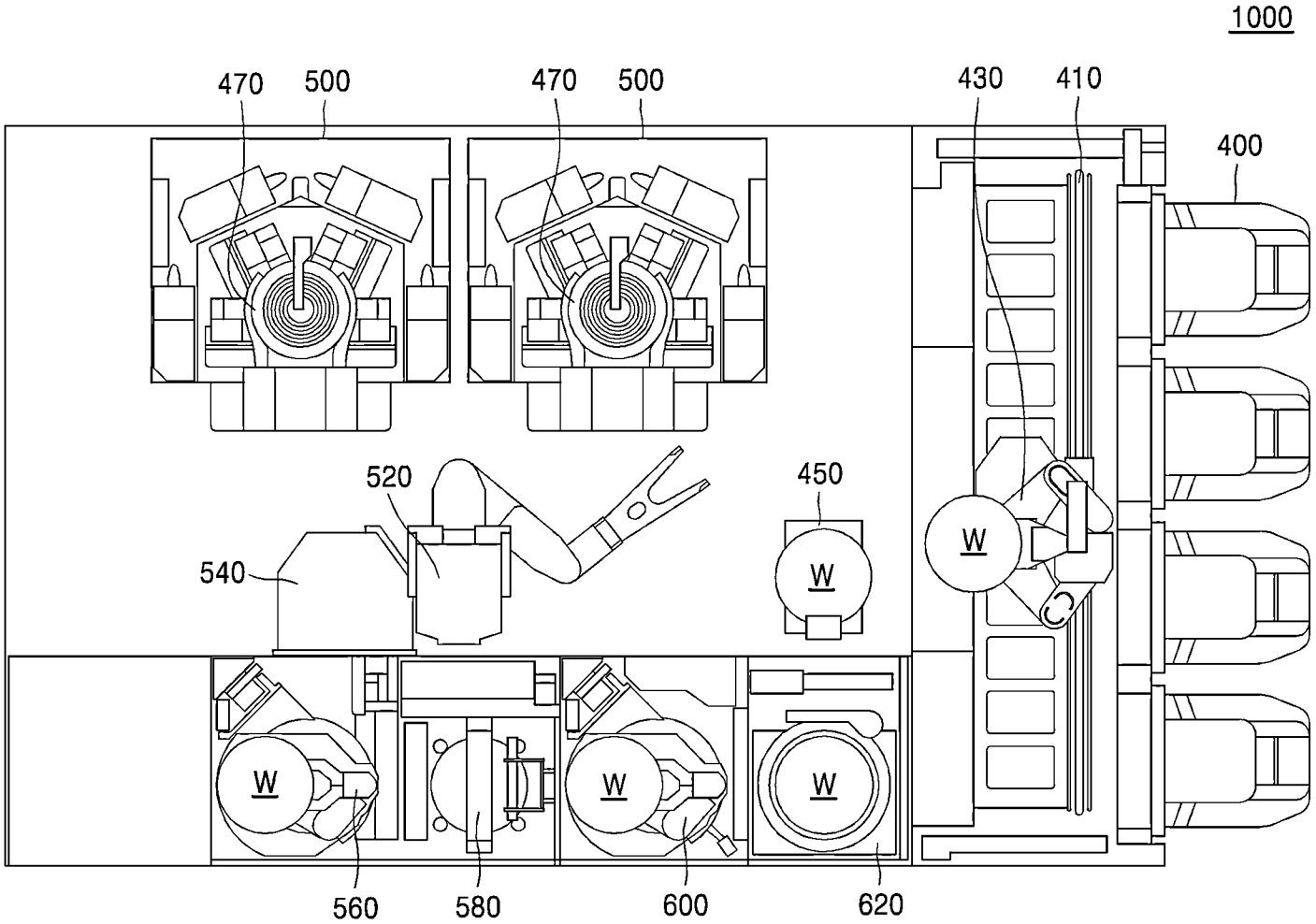
FIG. 1 is a plan view schematically illustrating an entire structure of a substrate processing system including a polishing apparatus according to an example embodiment.

Example embodiments will now be described more fully with reference to the accompanying drawings, in which some example embodiments are shown. The same elements in the drawings are denoted by the same reference numerals and a repeated explanation thereof will not be given.

Example embodiments now will be described more fully hereinafter with reference to the accompanying drawings, in which elements of the inventive concepts are shown. The inventive concepts may, however, be embodied in many different forms and should not be construed as limited to the example embodiments set forth herein. Rather, these example embodiments are provided so that this disclosure will be thorough and complete, and will fully convey the scope of example embodiments to one of ordinary skill in the art.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of example embodiments. For example, a first element may be named a second element and similarly a second element may be named a first element without departing from the scope of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments. It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A specific order of processes according to some example embodiments may be changed. For example, two processes consecutively described herein may be simultaneously performed or may be performed in an opposite order.

Variations from the shapes of the illustrations as a result, for example, of manufacturing techniques and/or tolerances, are to be expected. Thus, example embodiments should not be construed as limited to the particular shapes of regions illustrated herein but may be construed to include deviations in shapes that result, for example, from manufacturing.

Hereinafter, some example embodiments will be explained in further detail with reference to the accompanying drawings.

FIG. 1 is a plan view schematically illustrating an entire structure of a substrate processing system including a polishing apparatus according to an example embodiment.

For example, a substrate processing system 1000 may include a wafer loading/unloading port 400, a transfer rail 410, a first transfer robot 430, and a first wafer station 450 on which a wafer is arranged. The first transfer robot 430 may be used for transferring a wafer W between the wafer loading/unloading port 400 and the first wafer station 450. The first transfer robot 430 may move on the transfer rail 410.

A substrate processing system 1000 may include two polishing apparatuses 500, two centering loaders 470, a second transfer robot 520, and a second wafer station 540. The polishing apparatus 500 may polish a peripheral portion of the wafer W.

The wafer W loaded on the first wafer station 450 may be transferred to the centering loader 470. The centering loader 470 may hold the wafer W to mechanically or optically align a center of the wafer W. The wafer W whose center is aligned may be loaded on the polishing apparatus 500. The wafer W polished by the polishing apparatus 500 may be transferred to the second wafer station 540 by using the second transfer robot 520. The polishing apparatus 500 will be described in detail later.

The substrate processing system 1000 may include a third transfer robot 560, a washing unit 580, a fourth transfer robot 600, and a drying unit 620. The wafer loaded on the second wafer station 540 may be transferred to the washing unit 580 by using the third transfer robot 560 so that the wafer is to be washed. The washed wafer may be transferred to the drying unit 620 by using the fourth transfer robot 600 so that the washed wafer is to be dried. The dried wafer may be transferred to the wafer loading/unloading port 400 by using the first transfer robot 430.

Figure 2:
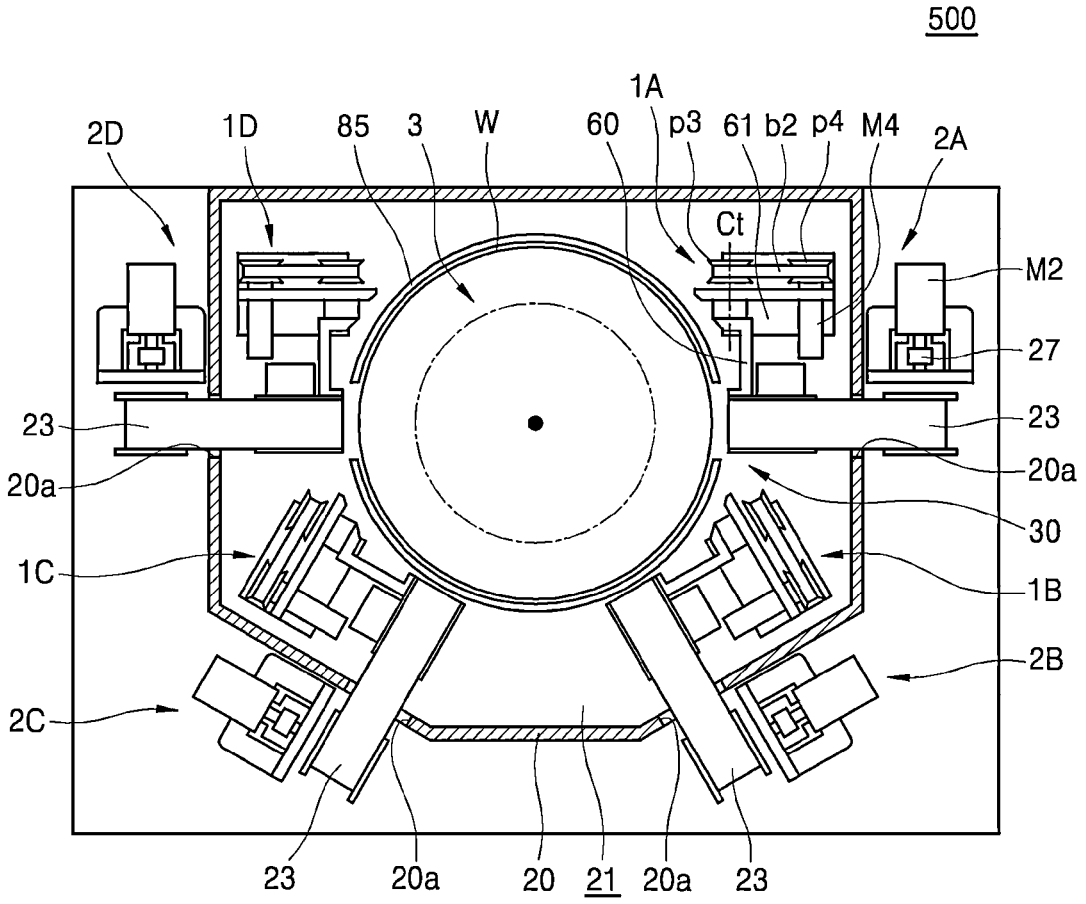
FIG. 2 is a plan view schematically illustrating a polishing apparatus that may be used for the substrate processing system of FIG. 1.
Figure 3:
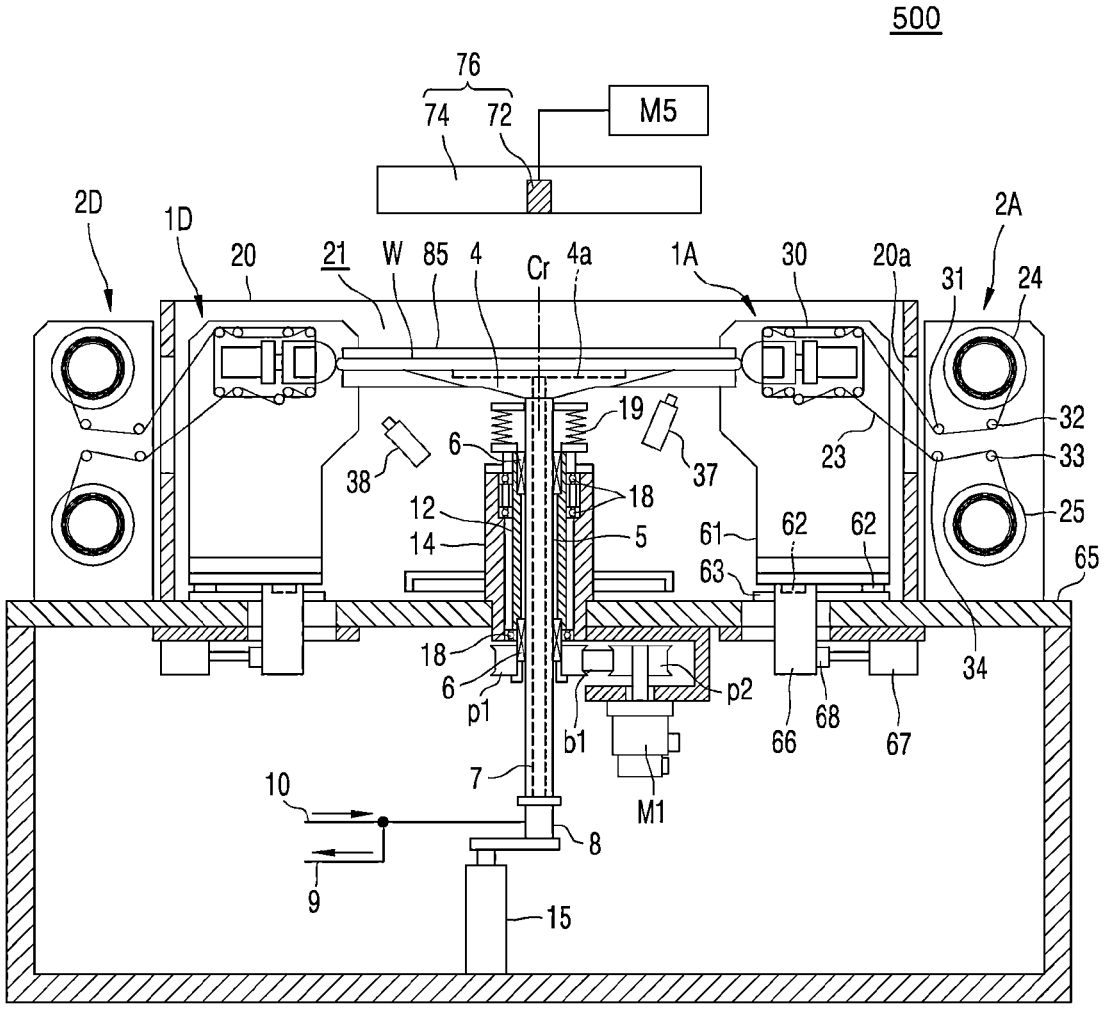
FIGS. 3 and 4 are vertical cross-sectional views of FIG. 2.
Figure 4:
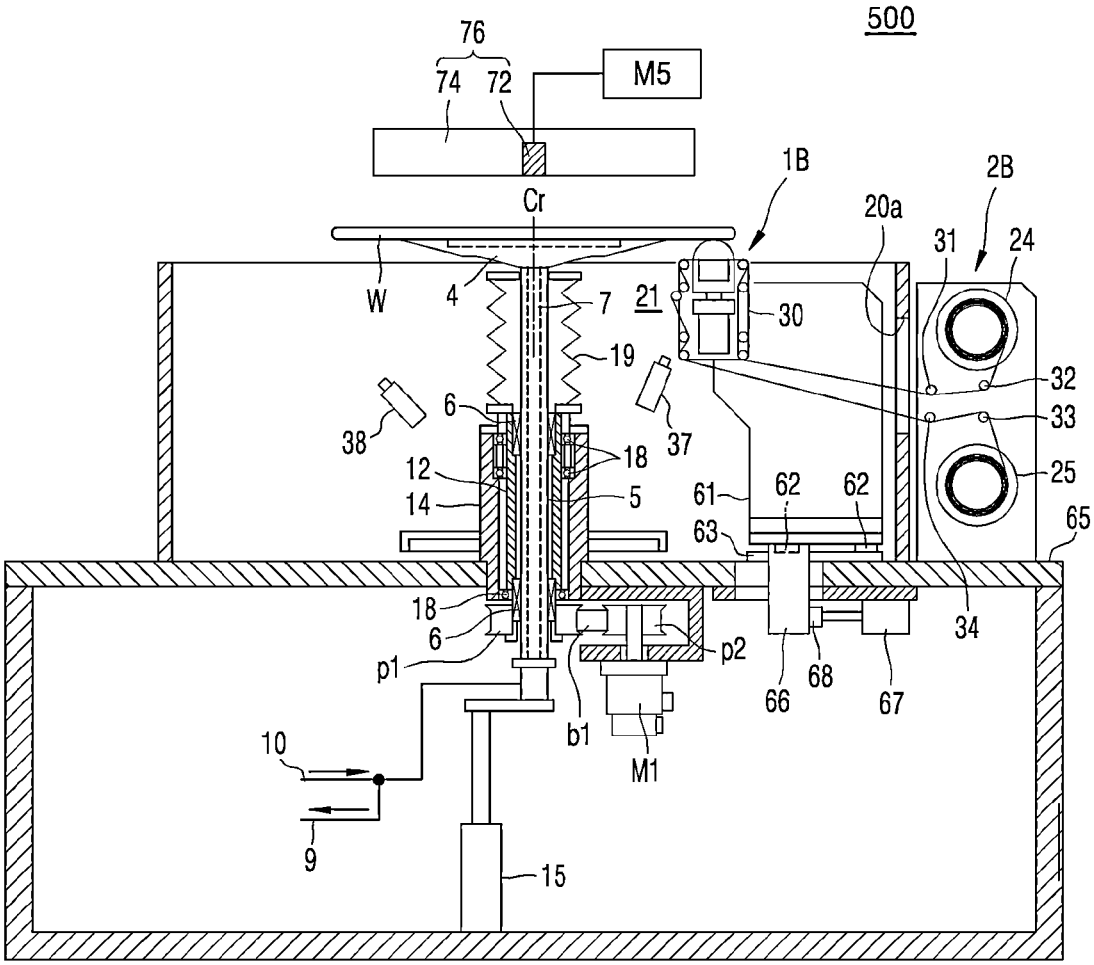
Figure 5:
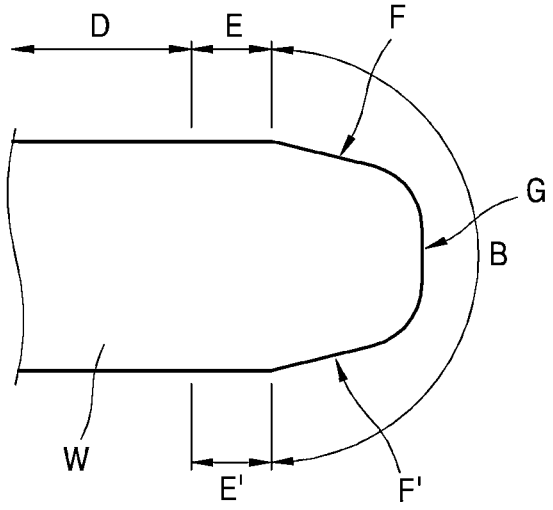
FIG. 5 is a cross-sectional view illustrating a peripheral portion of a wafer W.

FIG. 2 is a plan view schematically illustrating a polishing apparatus that may be used for the substrate processing system of FIG. 1. FIGS. 3 and 4 are vertical cross-sectional views of FIG. 2. FIG. 5 is a cross-sectional view illustrating a peripheral portion of a wafer W.

For example, the polishing apparatus 500 may be used for polishing a surface, a side surface, and a rear surface of the peripheral portion of the wafer W. A diameter of the wafer W may be 300 mm and semiconductor device forming films may be formed on a surface of the wafer W. In FIG. 5, the enlarged peripheral portion of the wafer W is illustrated.

In the wafer W, a device forming region D is a flat portion positioned several millimeters inward from an edge surface G. Another flat portion outside the device forming region D may be defined as a near upper edge portion E. In the wafer W, an upper inclined portion F, the edge surface G, and a lower inclined portion F' may collectively define an inclined portion B. A lower surface of the wafer W corresponding to the near upper edge portion E may be defined as a near lower edge portion E'.

The peripheral portion may be defined by the near upper edge portion E, the inclined portion B, and the near lower edge portion E'. Top and side surfaces of the peripheral portion may include the near upper edge portion E, the upper inclined portion F, and the edge surface G. A rear surface of the peripheral portion may include the near lower edge portion E' and the lower inclined portion F'.

The polishing apparatus 500 may include a chuck 3 for horizontally providing the wafer W (e.g., an object to be polished) and rotating the wafer W. The chuck 3 may be positioned in a center of the polishing apparatus 500. The wafer W may be provided on the chuck 3. The top surface, the side surface, and the rear surface of the peripheral portion of the wafer W provided on the chuck 3 may be exposed. A cup 85 for protecting the wafer W may be positioned around the wafer W on the chuck 3.

The chuck 3 may include a dish-shaped stage 4 capable of holding the lower surface of the wafer W by a vacuum suction power, a shaft 5 coupled to a center of the stage 4, and a motor M1 for rotating the shaft 5. The shaft 5 may be a hollow shaft. The wafer W may be arranged on the stage 4 so that the center of the wafer W is aligned with a rotation axis of the shaft 5.

The shaft 5 may be supported by ball spline bearings 6 that allow the shaft 5 to vertically move. The ball spline bearings 6 may be linear motion bearings. The stage 4 may include an upper surface having a groove 4*a*. The groove 4*a* may be connected to a communication line 7 extended through the shaft 5. The communication line 7 may be coupled to a vacuum line 9 through a rotation joint 8 provided at a lower end of the shaft 5. The communication line 7 may be connected to a nitrogen gas supplying line 10 used for discharging the processed wafer W from the stage 4 to the outside of the polishing apparatus.

The vacuum line 9 or the nitrogen gas supplying line 10 may be selectively coupled to the communication line 7 so that the wafer W may be attached to the upper surface of the stage 4 by vacuum suction or may be discharged from the upper surface of the stage 4.

The shaft 5 may be rotated by the motor M1 through a pulley p1 coupled to the shaft 5, a pulley p2 attached to a rotation shaft of the motor M1, and a belt b1 mounted on the pulleys p1 and p2. The rotation shaft of the motor M1 may be extended to run parallel with the shaft 5. Through the above-described configuration, the wafer W positioned on the upper surface of the stage 4 may be rotated by the motor M1.

The ball spline bearings 6 may allow the shaft 5 to freely move in a vertical direction. The ball spline bearings 6 may be mounted in a first casing 12. The shaft 5 may linearly move up and down with respect to the first casing 12 and the shaft 5 and the first casing 12 may integrally rotate. The shaft 5 may be coupled to an air cylinder 15. The air cylinder 15 may be an elevating mechanism. The shaft 5 and the stage 4 may be ascended and descended by the air cylinder 15.

A second casing 14 may be provided to surround the first casing 12. The first casing 12 and the second casing 14 may be concentrically arranged. Radial bearings 18 may be provided between the first casing 12 and the second casing 14 so that the first casing 12 is rotatably supported by the radial bearings 18. In such a structure, the chuck 3 may rotate the wafer W around a central axis Cr and may ascend and descend the wafer W along the central axis Cr.

When the shaft 5 ascends with respect to the first casing 12, in order to separate the ball spline bearings 6 and the radial bearings 18 from a polishing chamber 21, upper ends of the hollow shaft 5 and the first casing 12 may be coupled to a bellows 19 elongated in a vertical direction as illustrated in FIGS. 3 and 4. FIGS. 3 and 4 illustrate that the shaft 5 is lowered and the state 4 is in a polishing position. After a polishing process, the air cylinder 15 may lift the wafer W to a delivery position together with the stage 4 and the shaft 5. At this time, the wafer W may be discharged from the stage 4.

As illustrated in FIG. 2, the polishing apparatus 500 may include polishing head assemblies 1A, 1B, 1C, and 1D. The polishing head assemblies 1A, 1B, 1C, and 1D may be arranged to be around the wafer W, which will be mounted on the chuck 3. The polishing head assemblies 1A and 1D may include top surface and side surface polishing heads 30 used for polishing the top surface and/or the side surface of the peripheral portion of the wafer W. The polishing head assemblies 1B and 1C may include rear surface polishing heads 30 used for polishing the rear surface of the peripheral portion of the wafer W.

Tape supplying and recovering mechanisms 2A, 2B, 2C, and 2D for supplying or recovering polishing tapes 23 used for polishing the wafer W may be provided outside the polishing head assemblies 1A, 1B, 1C, and 1D in radial directions, respectively. The polishing head assemblies 1A, 1B, 1C, and 1D may be separated from the tape supplying and recovering mechanisms 2A, 2B, 2C, and 2D by a division wall 20. An internal space of the division wall 20 may provide the polishing chamber 21.

The four polishing head assemblies 1A, 1B, 1C, and 1D and the stage 4 may be positioned in the polishing chamber 21. The tape supplying and recovering mechanisms 2A, 2B, 2C, and 2D may be positioned outside the division wall 20 (e.g., outside the polishing chamber 21). The polishing head assemblies 1A, 1B, 1C, and 1D may have a same structure and the tape supplying and recovering mechanisms 2A, 2B, 2C, and 2D may have a same structure.

The polishing head assemblies 1A, 1B, 1C, and 1D may include the polishing heads 30 capable of polishing the peripheral portion of the wafer W as described above. The polishing heads 30 may press the polishing tapes 23 supplied by the tape supplying and recovering mechanisms 2A, 2B, 2C, and 2D to the peripheral portion of the wafer W. The four polishing head assemblies 1A, 1B, 1C, and 1D and the four tape supplying and recovering mechanisms 2A, 2B, 2C, and 2D may be provided in this example embodiment. However, the inventive concepts are not limited to such an arrangement. For example, two, three, or no less than four pairs of polishing head assemblies and tape supplying and recovering mechanisms may be provided.

Here, among the polishing head assemblies 1A, 1B, 1C, and 1D of the same structure and the tape supplying and recovering mechanisms 2A, 2B, 2C, and 2D of the same structure, as an example, the polishing head assembly 1A and the tape supplying and recovering mechanism 2A will be described.

The tape supplying and recovering mechanism 2A may include a supplying rill 24 for supplying the polishing tape 23 (e.g., a polishing tool) to the polishing head assembly 1A and a recovering rill 25 for recovering the polishing tape 23 used for polishing the wafer W. The supplying rill 24 may be arranged on the recovering rill 25. A motor M2 may be coupled to the supplying rill 24 and the recovering rill 25 through a coupling ring 27. In FIG. 2, for convenience sake, only the motor M2 coupled to the supplying rill 24 and the coupling ring 27 is illustrated. The motor M2 may be formed to apply a uniform torque in a desired (or alternatively, predetermined) rotation direction in order to apply a desired (or alternatively, predetermined) tension to the polishing tape 23.

The polishing tape 23 may be a long tape-shaped polishing tool and one of surfaces of the polishing tape forms a polishing surface. The polishing tape 23 may be wound around the supplying rill 24 mounted on the tape supplying and recovering mechanism 2A. The both surfaces of the wound polishing tape 23 may be supported by a rill plate (not shown), which is configured to not be folded. One end of the polishing tape 23 may be attached to the recovering rill 25 so that the recovering rill 25 winds the polishing tape 23 supplied to the polishing head assembly 1A to recover the polishing tape 23.

The polishing head assembly 1A may include the polishing head 30 capable of pressing the polishing tape 23 supplied by the tape supplying and recovering mechanism 2A to the peripheral portion of the wafer W to polish the peripheral portion of the wafer W. The polishing tape 23 may be supplied to the polishing head 30 so that the polishing surface of the polishing tape 23 faces the peripheral portion of the wafer W.

The tape supplying and recovering mechanism 2A may include a plurality of guide rollers 31, 32, 33, and 34. The polishing tape 23 supplied to the polishing head assembly 1A and recovered from the polishing head assembly 1A may be guided by the guide rollers 31, 32, 33, and 34. The polishing tape 23 may be supplied from the supplying rill 24 to the polishing head 30 through openings 20*a* formed in the division wall 20 and the used polishing tape 23 may be recovered by the recovering rill 25 through the openings 20*a*.

The polishing head 30 may be fixed to one end of a rotatable arm 60 with respect to an axis Ct, which runs parallel with a tangent line of the wafer W as illustrated in FIG. 2. The other end of the arm 60 may be coupled to a motor M4 through pulleys p3 and p4 and a belt b2. When the motor M4 rotates in a clockwise direction and a counter clockwise direction by a desired (or alternatively, predetermined) angle, the arm 60 may rotate around the axis Ct by a desired (or alternatively, predetermined) angle. In this example embodiment, the motor M4, the arm 60, the pulleys p3 and p4, and the belt b2 may form a tilt mechanism that tilts the polishing head 30.

The tilt mechanism may be mounted on a plate-shaped movable base 61. The movable base 61 may be movably coupled to a movable plate 65 through a guide unit 62 and a rail 63. The rail 63 may be linearly extended in a radial direction of the wafer W mounted on the chuck 3 so that the movable base 61 may move in the radial direction of the wafer W. A coupling plate 66 that passes through the movable plate 65 may be attached to the plate-shaped movable base 61. A linear actuator 67 may be coupled to the coupling plate 66 through a joint 68. The linear actuator 67 may be directly or indirectly fixed to the movable plate 65.

The linear actuator 67 may include, for example, a combination of a position setting motor and a ball screw or an air cylinder. The linear actuator 67, the rail 63, and the guide unit 62 may form a moving mechanism for linearly moving the polishing head 30 in the radial direction of the wafer W. For example, the moving mechanism may move the polishing head 30 along the rail 63 toward the wafer W and away from the wafer W. The tape supplying and recovering mechanism 2A may be attached to the movable plate 65.

FIG. 3 illustrates the polishing apparatus 500 configured to polish the side surface of the peripheral portion of the wafer W. When the polishing apparatus 500 polishes the surface of the peripheral portion of the wafer W, the chuck 3 on which the wafer W is mounted may descend to be positioned above the polishing head 30. FIG. 4 illustrates that the chuck 3 moves upward so that the polishing apparatus 500 polishes the rear surface of the peripheral portion of the wafer W. As described above, when the polishing head 30 is tilted, an inclined surface of the surface or rear surface of the peripheral portion of the wafer W may be polished.

In the polishing apparatus 500 according to the present example embodiment, when the wafer W is polished, a polishing solution supplying assembly 76 may supply a polishing solution to a center of the upper surface of the wafer W and form a liquid curtain above the wafer W for protecting the wafer W. The polishing solution supplying assembly 76 may include a nozzle supporting block 74 and a nozzle block 72 for spraying the polishing solution.

The nozzle block 72 may be connected to a motor M5 and may horizontally rotate with respect to the wafer W. Rotation of the nozzle block 72 may be selective and the nozzle block 72 may not rotate. The polishing solution supplying assembly 76 will be described in detail later.

A lower nozzle block 37 may be provided to supply the polishing solution to a boundary between the rear surface (e.g., the lower surface) of the wafer W and the stage 4 of the chuck 3. Pure water may be used as the polishing solution. When silica is used as polishing grains of the polishing tape 23, ammonia may be used as the polishing solution. The polishing apparatus 500 may include a washing nozzle block 38 for washing the polishing head 30 after the polishing process. The washing nozzle block 38 may spray a washing solution to the polishing head 30 in order to wash the polishing head 30 used for the polishing process.

Figure 6:
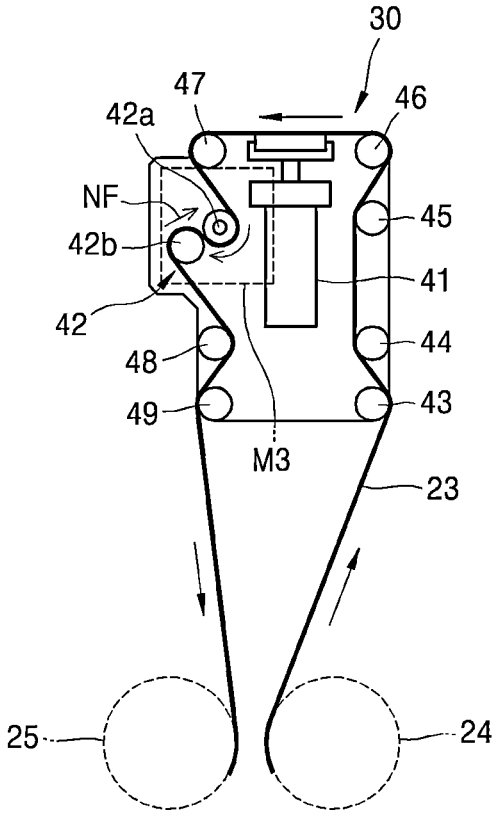
FIG. 6 is a view schematically illustrating a tape supplying and recovering mechanism and a polishing head of FIG. 2.

FIG. 6 is a view schematically illustrating a tape supplying and recovering mechanism and the polishing head of FIG. 2.

For example, the polishing head 30 may apply pressure to the rear surface of the polishing tape 23 in order to press the polishing tape 23 against the wafer W by a desired (or alternatively, predetermined) power. The polishing head 30 may further include a tape discharging mechanism 42 for discharging the polishing tape 23 from the supplying rill 24 to the recovering rill 25. The polishing head 30 may include a plurality of guide rollers 43, 44, 45, 46, 47, and 48 for guiding the polishing tape 23 to move to the peripheral portion of the wafer W.

The tape discharging mechanism 42 of the polishing head 30 may include a tape discharging roller 42*a*, a tape holding roller 42*b*, and a motor M3 for rotating the tape discharging roller 42*a*. The motor M3 may be arranged on one surface of the polishing head 30. The tape discharging roller 42*a* may be coupled to a rotation shaft of the motor M3.

The tape holding roller 42*b* may be adjacent to the tape discharging roller 42*a*. The tape holding roller 42*b* may be supported by a mechanism (not shown) that applies power to the tape holding roller 42*b* in a direction indicated by NF (e.g., toward the tape discharging roller 42*a*) to press the tape holding roller 42*b* to the tape discharging roller 42*a*.

The polishing tape 23 may pass between the tape discharging roller 42*a* and the tape holding roller 42*b* and may be held by the tape discharging roller 42*a* and the tape holding roller 42*b*. The tape discharging roller 42*a* may have a contact surface that contacts the polishing tape 23. The entire contact surface may be covered with urethane resin. Due to such a structure, friction between the tape discharging roller 42*a* and the polishing tape 23 may increase, and thus the tape discharging roller 42*a* may discharge the polishing tape 23 without sliding.

When the motor M3 rotates, the tape discharging roller 42*a* may rotate to discharge the polishing tape 23 from the supplying rill 24 to the recovering rill 25 through the polishing head 30. The tape holding roller 42*b* may freely rotate around its axis to rotate when the polishing tape 23 is discharged by the tape discharging roller 42*a*.

In such a method, rotation of the motor M3 may be switched into a tape discharging work by friction between the contact surface of the tape discharging roller 42*a* and the polishing tape 23, a winding angle of the polishing tape 23, and holding of the polishing tape 23 by the tape holding roller 42*b*. The polishing tape 23 may be discharged downward from a position where the polishing tape 23 contacts the wafer W.

Figure 7:
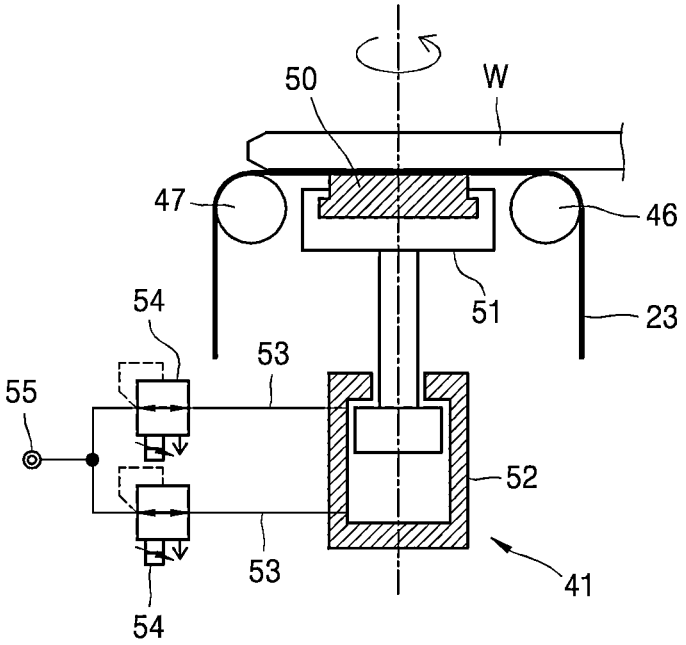
FIGS. 7 and 8 are views illustrating a wafer polishing process using a pressing mechanism of the polishing head of FIG. 6.
Figure 8:
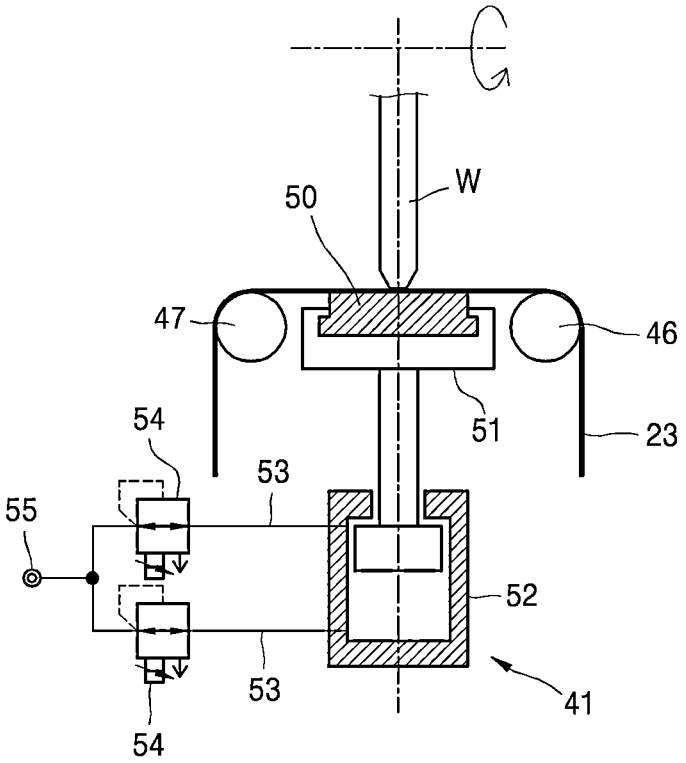

FIGS. 7 and 8 are views illustrating a wafer polishing process using a pressing mechanism of the polishing head of FIG. 6.

For example, FIG. 7 illustrates that the rear surface of the peripheral portion of the wafer W is polished by using a pressing mechanism 41 and FIG. 8 illustrates that the side surface of the peripheral portion of the wafer W is polished by using the pressing mechanism 41. The pressing mechanism 41 of FIGS. 7 and 8 may include a pressing pad 50 positioned on the back of the polishing tape 23, which is provided on two guide rollers 46 and 47, a pad holder 51 for holding the pressing pad 50, and an air cylinder (an actuator) 52 for moving the pad holder 51 toward the wafer W.

The guide rollers 46 and 47 may be arranged in a front part of the polishing head 30. The air cylinder 52 may be a single load cylinder. Two air pipes 53 may be coupled to the air cylinder 52 through two ports. Electropneumatic regulators 54 may be provided to the air pipes 53, respectively. A first end (e.g., an entrance end) of the air pipe 53 may be coupled to an air supplying source 55 and a second end (e.g., an exit end) of the air pipe 53 may be coupled to a port of the air cylinder 52.

The electropneumatic regulators 54 may be controlled by a signal in order to appropriately control the pressure of an air to be supplied to the air cylinder 52. In such a method, a press force of the pressing pad 50 is controlled by the pressure of the air supplied to the air cylinder 52 and the polishing surface of the polishing tape 23 may press the wafer W by a controlled pressure.

Figure 9:
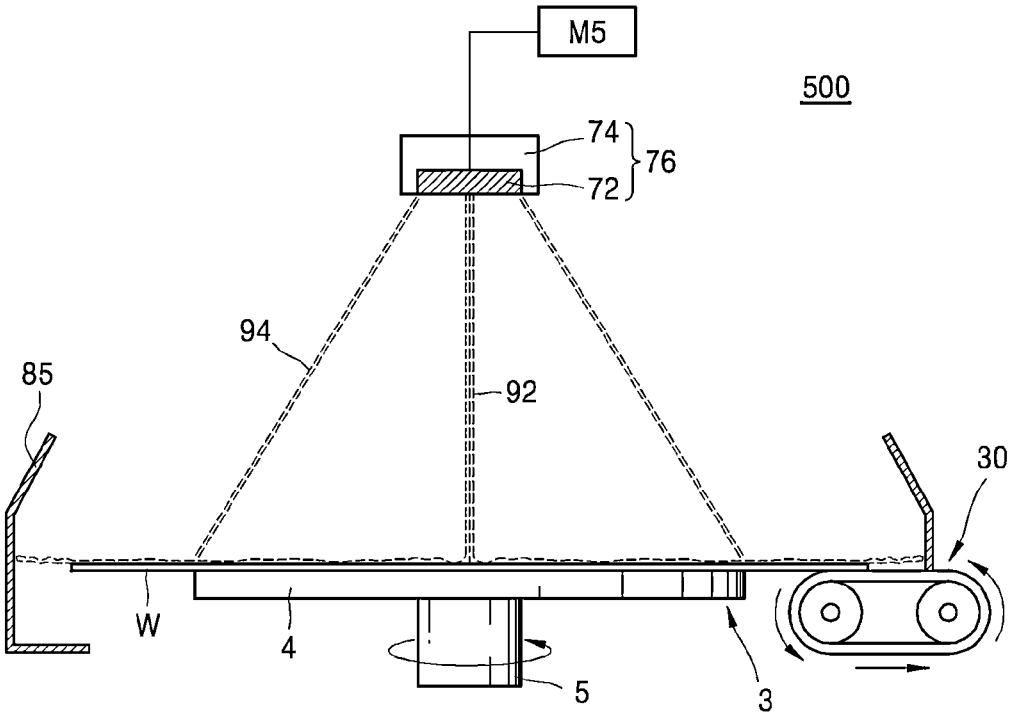
FIGS. 9 and 10 are cross-sectional views illustrating that a rear surface of a peripheral portion of a wafer is polished by using the polishing apparatus of FIGS. 2 to 4.
Figure 10:
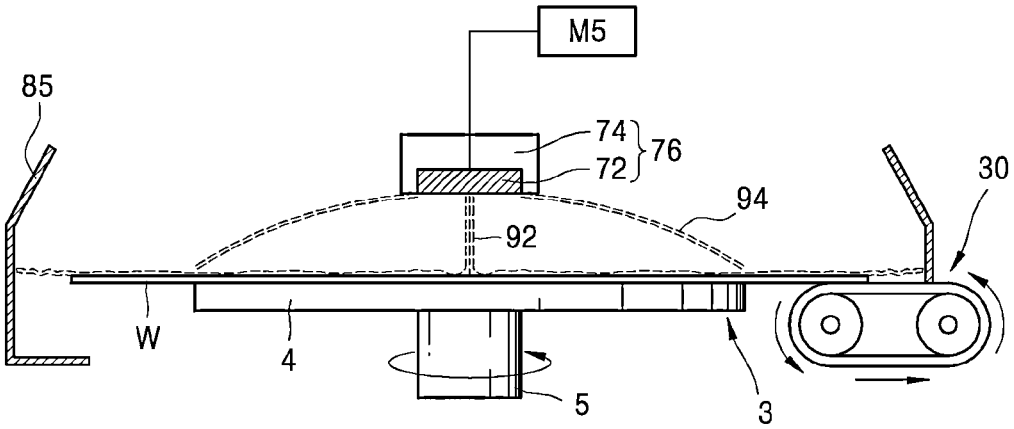

FIGS. 9 and 10 are cross-sectional views illustrating that a rear surface of a peripheral portion of a wafer is polished by using the polishing apparatus of FIGS. 2 to 4.

For example, the wafer W may be horizontally mounted on the stage 4 of the chuck 3 that forms the polishing apparatus 500. The diameter of the wafer W may be larger than that of the stage 4 so that the peripheral portion of the wafer W can be exposed to the outside of the stage 4. The wafer W mounted on the stage 4 may be rotated by the rotation of the shaft 5.

The polishing head 30 may be positioned on the rear surface of the peripheral portion of the wafer W. The polishing head 30 may be used for polishing the rear surface of the peripheral portion of the wafer W. The polishing solution supplying assembly 76 may be formed above the wafer W.

The polishing solution supplying assembly 76 may include the nozzle supporting block 74 and the nozzle block 72 for spraying a polishing solution 92. The motor M5 capable of rotating the nozzle block 72 may be connected to the nozzle block 72. The polishing solution supplying assembly 76 may supply the polishing solution 92 to the center of the upper surface of the wafer W so that the polishing solution 92 is sprayed to form a liquid curtain 94, which is capable of protecting the wafer W when the wafer W is polished.

The liquid curtain 94 may be a polishing solution curtain created by the polishing solution 92. The liquid curtain 94 may be a pure water curtain when the polishing solution is pure water. A shape of the liquid curtain 94 may vary with a spray type of the polishing solution 92. In FIG. 9, the liquid curtain 94 having a V-shape may be formed on the wafer W. In FIG. 10, the liquid curtain 94 having a U-shape may be formed. As illustrated in FIGS. 9 and 10, a curvature of the liquid curtain 94 may be controlled.

The liquid curtain 94 may prevent foreign substances that break off from the wafer W during polishing or the polishing solution 92 from bouncing by the cup 85 and/or contaminating the surface of the wafer W. In FIG. 9, it is illustrated that only the rear surface of the peripheral portion of the wafer W is polished. However, when the side surface or the top surface of the wafer W is polished, the foreign substances that break off from the wafer W or the polishing solution may also contaminate the surface of the wafer W. Therefore, the liquid curtain 94 may prevent the surface of the wafer W from being contaminated when the peripheral portion of the wafer W is polished. The polishing solution supplying assembly 76 will be described in detail later.

Figure 11:
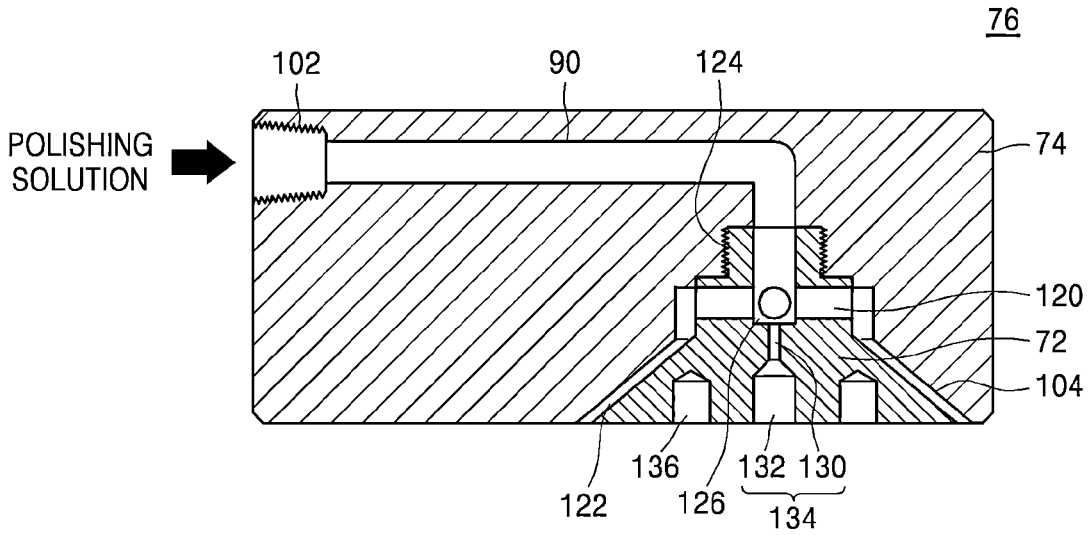
FIG. 11 is a cross-sectional view illustrating a polishing solution supplying assembly of FIGS. 2 to 4.
Figure 12:
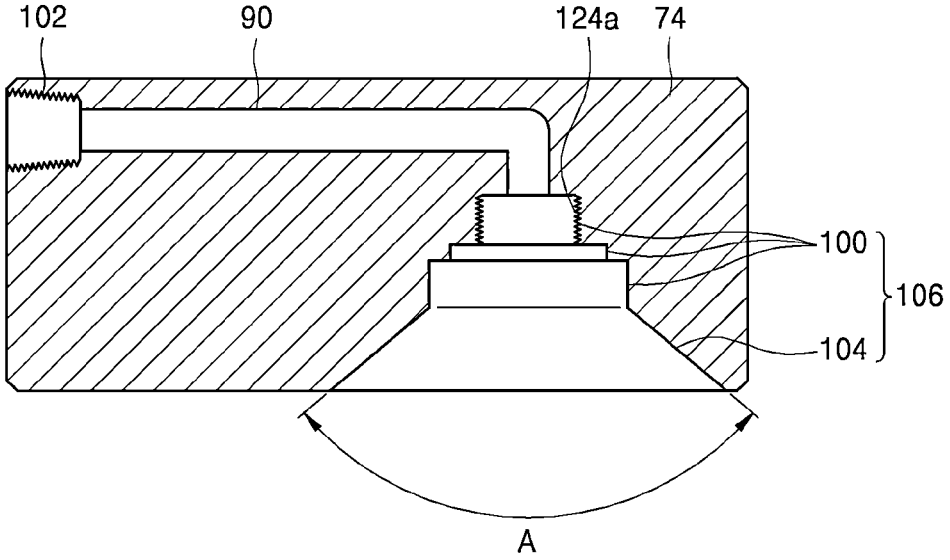
FIG. 12 is a cross-sectional view illustrating a nozzle supporting block of FIG. 11.
Figure 13:
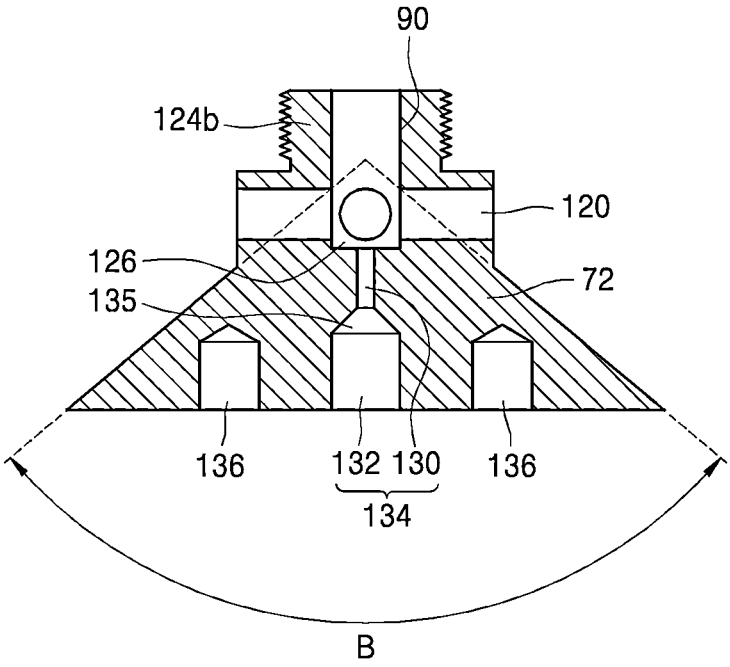
FIG. 13 is a cross-sectional view illustrating a nozzle block of FIG. 11.
Figure 14:
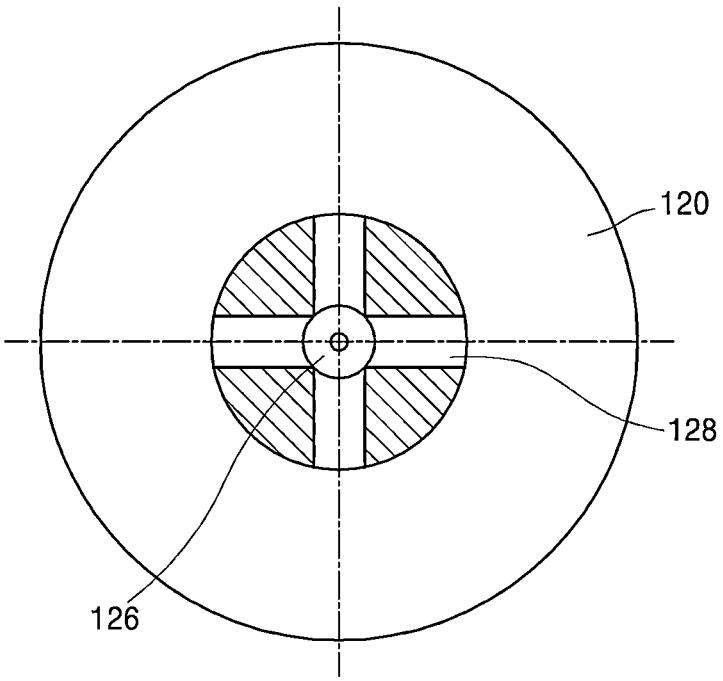
FIG. 14 is a plan view of a distributing plate included in the nozzle block of FIG. 13.
Figure 15:
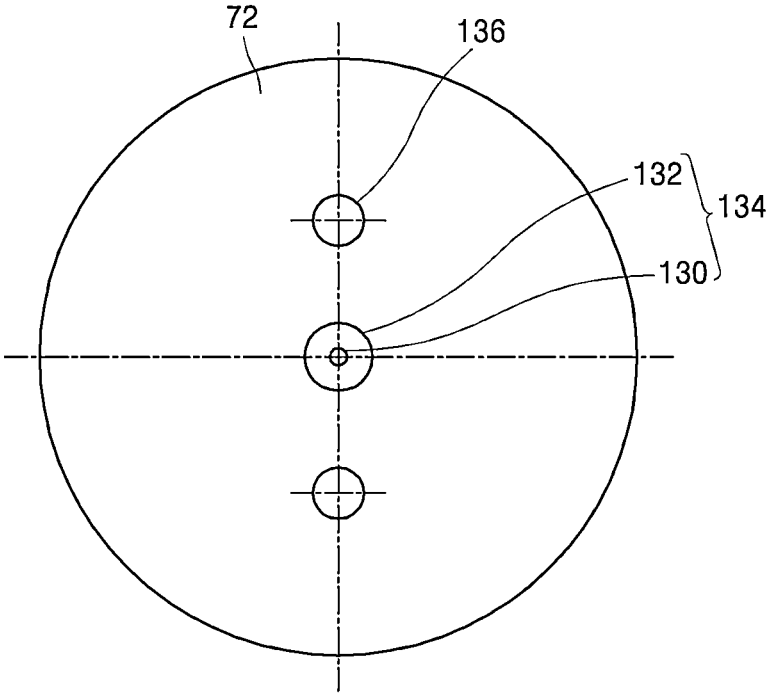
FIG. 15 is a view illustrating a bottom surface of the nozzle block of FIG. 13.

FIG. 11 is a cross-sectional view illustrating a polishing solution supplying assembly of FIGS. 2 to 4. FIG. 12 is a cross-sectional view illustrating a nozzle supporting block of FIG. 11. FIG. 13 is a cross-sectional view illustrating a nozzle block of FIG. 11. FIG. 14 is a plan view of a distributing plate included in the nozzle block of FIG. 13. FIG. 15 is a view illustrating a bottom surface of the nozzle block of FIG. 13.

For example, the polishing solution supplying assembly 76 may include a polishing solution supplying line 90 for supplying the polishing solution and the nozzle supporting block 74 including an internal groove 106 connected to the polishing solution supplying line 90. A fastening unit 102 capable of connecting the polishing solution supplying line 90 and an external polishing solution supplying source line (not shown) may be provided on one side of the nozzle supporting block 74. The internal groove 106 may include a multistage groove 100 connected to the polishing solution supplying line 90 and an inclined groove 104 connected to the multistage groove 100. The multistage groove 100 provided in the nozzle supporting block 74 may be formed of grooves having different diameters. In the nozzle supporting block 74, the curvature of the liquid curtain may be determined in accordance with a radial angle A of the inclined groove 104 based on a central line of the inclined groove 104. The radial angle A may be, for example, between a range of about 95 to about 105 degrees.

The polishing solution supplying assembly 76 includes the nozzle block 72 inserted into and fastened to the internal groove 106 of the nozzle supporting block 74 and including the distributing plate 120 for distributing the polishing solution. The nozzle supporting block 74 and the nozzle block 72 may be fastened by a fastening unit 124. The fastening unit 124 may be formed of a female screw 124*a* provided in the multistage groove 100 of the nozzle supporting block 74 and a male screw 124*b* provided in a leading end of the nozzle block 72. In the nozzle block 72, the curvature of the liquid curtain may be determined in accordance with a radial angle B of the nozzle block 72. The radial angle B may be, for example, between a range of about 95 to about 105 degrees.

The nozzle block 72 may horizontally rotate with respect to the wafer W as described above. The distributing plate 120 may include a central through hole 126 provided in a center and a distributing groove 128 for radially distributing the polishing solution around an upper surface of the central through hole 126. A through nozzle 134 that passes through the nozzle block 72 may be formed in the distributing plate 120.

The polishing solution may be supplied to the center of the wafer W through the through nozzle 134. The through nozzle 134 may include a first through nozzle 130 of a first diameter. The first through nozzle 130 may be connected to the distributing plate 120, and a second through nozzle 132, which has a second diameter larger than the first diameter of the first through hole nozzle 130, may be connected to the first through nozzle 130. A leading end of the second through nozzle 132 connected to the first through nozzle 130 may include an internal inclined groove 135. A hole 136 may be formed in a lower surface of the nozzle block 72 so that a fastening tool may be used when the nozzle block 72 is fastened to the nozzle supporting block 74.

The polishing solution supplying assembly 76 may include a slit nozzle 122 positioned between the nozzle supporting block 74 and the nozzle block 72 to spray the polishing solution. The slit nozzle 122 may be formed in a space between the nozzle supporting block 74 and the nozzle block 72. The space between the nozzle supporting block 74 and the nozzle block 72 may be controlled in accordance with sizes of the nozzle supporting block 74 and the nozzle block 72.

The distributing groove 128 of the distributing plate 120 included in the nozzle block 72 may be connected to the slit nozzle 122. The slit nozzle 122 may be formed along a surface of the inclined groove 104 of the nozzle supporting block 74. A diameter of the slit nozzle 122 may be determined in accordance with diameters of the through nozzles 130 and 132, for example, a diameter of the first through nozzle 130. The curvature of the liquid curtain sprayed from the slit nozzle 122 may be determined in accordance with the diameter of the slit nozzle 122.

The polishing solution may be sprayed through the slit nozzle 122 so that the above-described liquid curtain may be formed. As described above, the internal groove 106 of the nozzle supporting block 74 may include the inclined groove 104. Therefore, the U-shaped or V-shaped liquid curtain may be formed by the polishing solution sprayed through the slit nozzle 122.

The above-described polishing solution supplying assembly 76 may form the liquid curtain by supplying the polishing solution through the polishing solution supplying line 90 and spraying the polishing solution through the slit nozzle 122.

Figure 16:
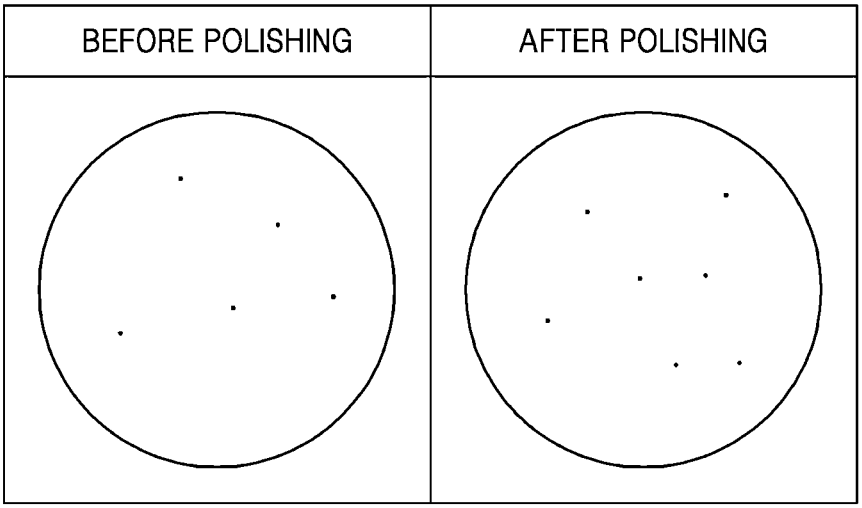
FIG. 16A is a particle map diagram of a wafer when the wafer is polished using a liquid curtain according to one of the example embodiments illustrated in FIGS. 9 and 10.
FIG. 16B is a particle map diagram of a wafer when the wafer is polished without using a liquid curtain according to a comparative example.
Figure 16:
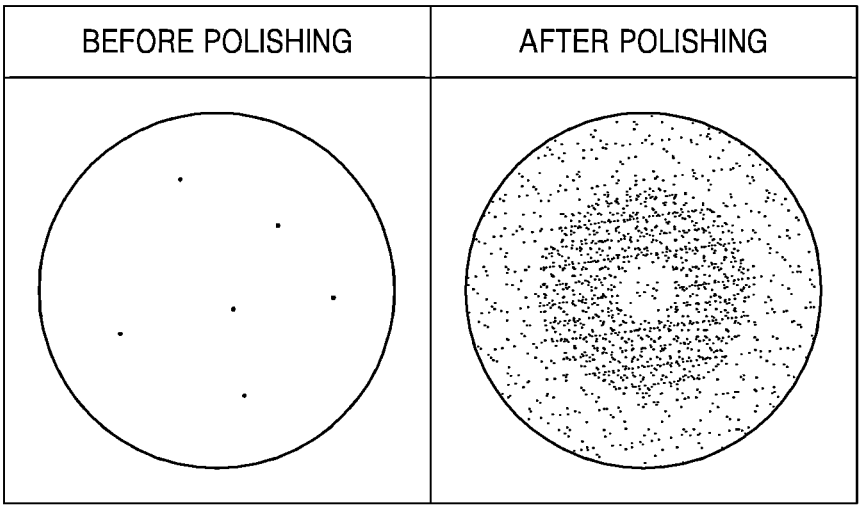

FIG. 16A is a particle map diagram of a wafer when the wafer is polished using a liquid curtain according to one of example embodiments illustrated in FIGS. 9 and 10. FIG. 16B is a particle map diagram of a wafer when the wafer is polished without using a liquid curtain according to a comparative example.

For example, as illustrated in FIG. 16A, when the peripheral portion of the wafer W is polished by the polishing apparatus using the liquid curtain according to some example embodiments, particle map diagrams before and after polishing are the same.

On the other hand, as illustrated in FIG. 16B, when the peripheral portion of the wafer W is polished by the polishing apparatus without using the liquid curtain according to the comparative example, many particles may be observed in the particle map diagram of the wafer after polishing. The particles observed on the wafer may significantly reduce yield of a semiconductor device.

Figure 17:
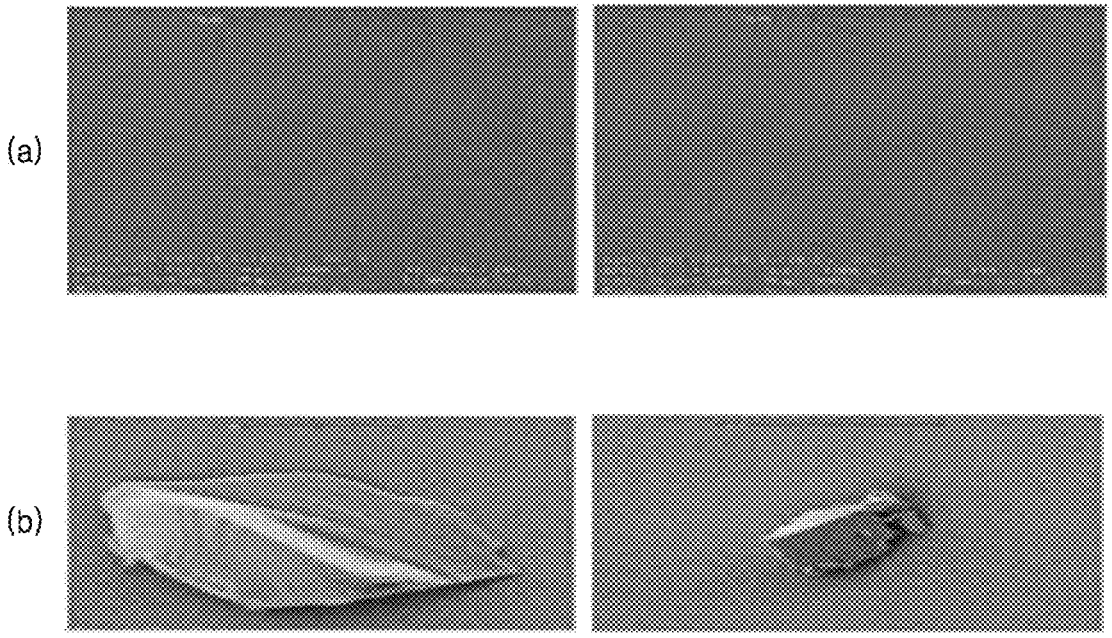
FIG. 17A is a view illustrating particles observed on a surface of a wafer when the wafer is polished using a liquid curtain according to one of the example embodiments illustrated in FIGS. 9 and 10.
FIG. 17B is a view illustrating particles observed on a surface of a wafer when the wafer is polished without using a liquid curtain according to a comparative example.

FIG. 17A is a view illustrating particles observed on a surface of a wafer when the wafer is polished using a liquid curtain according to one of the example embodiments illustrated in FIGS. 9 and 10. FIG. 17B is a view illustrating particles observed on a surface of a wafer when the wafer is polished without using a liquid curtain according to a comparative example.

For example, as illustrated in FIG. 17A, when the peripheral portion of the wafer W is polished by the polishing apparatus using the liquid curtain according to some example embodiments, angular particles may not be observed on the wafer W.

By contrast, as illustrated in FIG. 17B, when the peripheral portion of the wafer W is polished by the polishing apparatus without using the liquid curtain according to the comparative example, angular particles may be observed on the wafer. The angular particles observed on the wafer may significantly reduce yield of a semiconductor device.

While example embodiments have been particularly shown and described with reference to some example embodiments thereof, it will be understood that various changes in form and details may be made therein without departing from the spirit and scope of the following claims.

What is claimed is:

1. A polishing apparatus, comprising:

a chuck configured to support a wafer while exposing a peripheral portion of the wafer;

a polishing head configured to polish the peripheral portion of the wafer; and a polishing solution supplying assembly above the chuck, the polishing solution supplying assembly configured to spray a polishing solution on the wafer in a liquid curtain form, wherein the polishing solution supplying assembly includes, a nozzle supporting block having an internal groove, the internal groove connected to a polishing solution supplying line through which the polishing solution is supplied, a nozzle block coupled to the internal groove of the nozzle supporting block, the nozzle block including a distributing plate configured to distribute the polishing solution; and a slit nozzle positioned between the nozzle supporting block and the nozzle block, the slit nozzle configured to spray the polishing solution, and wherein the internal groove of the nozzle supporting block includes an inclined groove, and the slit nozzle is provided along a surface of the inclined groove.

2. The polishing apparatus of claim 1, wherein the polishing head has a side surface and a top surface polishing portion, the top surface and the side surface polishing portion configured to polish a side surface and a top surface of the peripheral portion of the wafer.

3. The polishing apparatus of claim 1, wherein the polishing head has a rear surface polishing portion, the rear surface polishing portion configured to polish a rear surface of the peripheral portion of the wafer.

4. The polishing apparatus of claim 1, wherein the polishing solution supplying assembly includes a slit nozzle configured to spray the polishing solution.

5. The polishing apparatus of claim 1, wherein the polishing solution supplying assembly includes a nozzle block configured to horizontally rotate with respect to the wafer.

6. The polishing apparatus of claim 1, wherein the distributing plate includes a through nozzle, the through nozzle passing through the nozzle block and configured to supply the polishing solution to a center of the wafer.

7. The polishing apparatus of claim 1, wherein the distributing plate includes:

a central through hole provided at a center; and a distributing groove configured to radially distribute the polishing solution around an upper surface of the central through hole.

8. The polishing apparatus of claim 7, wherein the distributing groove is connected to the slit nozzle.

9. A polishing apparatus, comprising:

a chuck configured to at least partially support a wafer while exposing a peripheral portion thereof;

a polishing pad configured to polish the exposed peripheral portion of the wafer; and a polishing solution supplying assembly above the chuck, the polishing solution supplying assembly including an inclined slit nozzle, a nozzle supporting block on the chuck, a nozzle block coupled to the nozzle supporting block, and the inclined slit nozzle between the nozzle supporting block and the nozzle block and configured to spray a polishing solution on the chuck in a liquid curtain form.

10. The polishing apparatus of claim 9, wherein the nozzle supporting block includes an internal groove, and the nozzle block is coupled to the nozzle supporting block by coupling the nozzle block to the internal groove of the nozzle supporting block.

11. The polishing apparatus of claim 10, wherein the internal groove has an inclination and the inclined slit nozzle is between the nozzle supporting block and the nozzle block along the inclination of the internal groove.

12. The polishing apparatus of claim 9, wherein the nozzle block includes a distributing plate configured to one of horizontally and radially distribute the polishing solution and a through nozzle connected to the distributing plate.

* * * * *